US008054001B2

(12) United States Patent
Wang et al.

(10) Patent No.: US 8,054,001 B2
(45) Date of Patent: Nov. 8, 2011

(54) CIRCUIT STRUCTURE FOR LCD BACKLIGHT

(75) Inventors: Xiaojun Wang, Shenzhen (CN); Sheng-Tai Lee, Taipei (TW); Youling Li, Shenzhen (CN); Da Liu, Milpitas, CA (US); Ru Guo, Santa Clara, CA (US)

(73) Assignee: O2Micro Inc, Santa Clara, CA (US)

( * ) Notice: Subject to any disclaimer, the term of this patent is extended or adjusted under 35 U.S.C. 154(b) by 1192 days.

(21) Appl. No.: 11/600,615

(22) Filed: Nov. 15, 2006

(65) Prior Publication Data

US 2008/0067944 A1 Mar. 20, 2008

Related U.S. Application Data

(60) Provisional application No. 60/845,783, filed on Sep. 18, 2006.

(51) Int. Cl.
*G05F 1/00* (2006.01)

(52) U.S. Cl. ..... 315/291; 315/282; 315/276; 315/312; 315/119

(58) Field of Classification Search ..... 315/276–278, 315/274, 282, 312, 291, DIG. 2, 224, 119; 345/102, 87, 84, 55, 30; 349/70, 61, 56
See application file for complete search history.

(56) References Cited

U.S. PATENT DOCUMENTS

| | | | | |
|---|---|---|---|---|
| 6,534,934 | B1 * | 3/2003 | Lin et al. | 315/312 |
| 7,002,304 | B2 * | 2/2006 | Chan et al. | 315/282 |
| 7,061,183 | B1 * | 6/2006 | Ball | 315/277 |
| 7,242,151 | B2 * | 7/2007 | Chan et al. | 315/278 |
| 7,271,549 | B2 * | 9/2007 | Wey et al. | 315/276 |
| 7,294,971 | B2 * | 11/2007 | Jin | 315/177 |
| 7,319,297 | B2 * | 1/2008 | Kuo | 315/282 |
| 7,372,213 | B2 * | 5/2008 | Kuo et al. | 315/282 |
| 7,667,410 | B2 * | 2/2010 | Kim et al. | 315/278 |
| 7,667,411 | B2 * | 2/2010 | Kim et al. | 315/282 |
| 2004/0000879 | A1 * | 1/2004 | Lee | 315/291 |
| 2005/0218827 | A1 * | 10/2005 | Ushijima et al. | 315/224 |

* cited by examiner

*Primary Examiner* — Jacob Y Choi
*Assistant Examiner* — Ephrem Alemu

(57) ABSTRACT

A circuit structure for LCD backlight is disclosed in the present invention. The circuit structure includes an inverter topology, a current balance circuit, and a plurality of loads. The current balance circuit is coupled to the plurality of loads and capable of balancing current of N loads by using N/2−1 balance chokes. The circuit structure may further include a protection circuit which is coupled to the low voltage sides of the plurality of loads. The protection circuit is capable of sensing lamp voltages and providing a feedback signal to a controller. Furthermore, the protection circuit is composed of count-reduced and cost-competitive electronic elements.

17 Claims, 14 Drawing Sheets

(E)

(F)

| SETTING | CCFL1 | CCFL2 | CCFL3 | CCFL4 | CCFL5 | CCFL6 | CCFL7 | CCFL8 | CCFL9 | CCFL10 | CCFL11 | CCFL12 | DEVIATION |
|---|---|---|---|---|---|---|---|---|---|---|---|---|---|
| 4MARMS | 4.01 | 4.06 | 3.90 | 4.13 | 4.03 | 4.12 | 4.05 | 3.92 | 3.86 | 3.64 | 3.68 | 3.69 | +/-0.25MA |
| 6MARMS | 5.93 | 5.71 | 5.82 | 5.88 | 5.93 | 6.06 | 6.12 | 6.14 | 6.20 | 6.09 | 6.20 | 6.21 | +/-0.25MA |
| 8MARMS | 8.21 | 8.15 | 8.11 | 8.13 | 8.09 | 8.00 | 7.98 | 7.90 | 7.86 | 7.97 | 7.88 | 8.22 | +/-0.17MA |

FIG. 7

CIRCUIT STRUCTURE FOR LCD BACKLIGHT

RELATED APPLICATION

This application claims the benefit of U.S. Provisional Application No. 60/845,783, filed on Sep. 18, 2006, the specification of which is hereby incorporated in its entirety by reference.

BACKGROUND OF THE INVENTION

1. Field of the Invention

The present invention relates to a backlight circuit, and more particularly to a liquid crystal display (LCD) backlight circuit with multiple lamps.

2. Description of the Related Art

LCD panels are used in various applications ranging from portable electronic devices to fixed location units, such as video cameras, automobile navigation systems, laptop PCs and industrial machines. The LCD panel itself cannot emit light but must be back lighted by a light source. The most commonly used backlight source is a cold-cathode fluorescent lamp (CCFL). Usually, a high alternating current (AC) signal is required to ignite and run the CCFL. To generate such a high AC signal from a direct current (DC) power source, e.g., a rechargeable battery, a DC/AC inverter is designed.

However, in recent years, there has been increasing interest in large size LCD displays, as required in LCD TV sets and computer monitors, which require multiple CCFLs to provide necessary illumination. Usually, the DC/AC inverter drives multiple CCFLs coupled in parallel and the CCFLs may also be configured in other ways. One parallel configuration is the direct parallel connection of the CCFLs. This configuration has the well-known problem that CCFL currents may not be balanced owing to the lamp voltage variation and the constant voltage load characteristic of the CCFLs. The imbalance of CCFL currents causes a reduced lifetime of the CCFL and non-uniformity of brightness.

Another parallel configuration is to make the parallel connection at the transformer primary side, as shown in FIG. 1, which illustrates a schematic diagram of a prior art circuit 100 for driving a plurality of CCFLs 140A to 140N. The circuit 100 is composed of a DC power source 110, an inverter circuit 120, a plurality of transformers 130A to 130N, a protection circuit 150 and a controller 160. The inverter circuit 120 is connected to a parallel connection of the primary windings of the plurality of transformers 130A to 130N. The inverter circuit 120 and the plurality of transformers 130A to 130N form an inverter topology, which is well known in the art. The inverter topology converts a DC input voltage VIN from the DC power source 110, e.g., a battery, to a desired AC output voltage VOUT. Those skilled in the art will recognize that inverter topology may be a Royer, a full bridge, a half bridge, a push-pull, and a class D. The AC output voltage VOUT is eventually delivered to the plurality of CCFLs 140A to 140N, which are respectively connected to the secondary windings of the plurality of transformers 130A to 130N.

Furthermore, by sensing the lamp currents IS1 to ISN, the protection circuit 150 may detect a short-circuit condition and then produce a current feedback signal ISEN. By sensing the high side voltages HV1 to HVN of the CCFLs, the protection circuit 150 may detect an open or broken lamp condition in which the CCFL is not connected to the inverter topology, fails to ignite or is broken, and then produce a voltage feedback signal VSEN. The current and voltage feedback signals ISEN and VSEN are then sent to the controller 160 that responses to these feedback signals and takes corresponding actions to prevent damages.

Though the parallel connection at the transformer primary side as illustrated in FIG. 1 may minimize the effect of the lamp voltage variation, which in turn improves the current balance, some drawbacks may impact the performance/cost of the configuration shown in FIG. 1. One drawback lies in that due to the tremendous number of transformers 130A to 130N, the circuit 100 will have an increased cost compared with the configuration of direct parallel connection of the CCFLs. Additionally, elements in the protection circuit 150 for sensing lamp voltages are connected to the high voltage sides HV1 to HVN, which typically have a voltage of more than 1,000 volts. The elements capable of enduring such a high voltage are usually expensive and consequently the overall cost is increased. Furthermore, when connecting the elements to the high voltage sides HV1 to HVN, operators require extra attention to prevent any arcing or hazard. Another drawback lies in that the protection circuit 150 as represented in FIG. 1 is complicated, and the complexity of the protection circuit 150 will become problematic as the number of lamps increases.

FIG. 2A illustrates a schematic diagram of another prior art driving circuit 200A, which is disclosed in U.S. Pat. No. 6,781,325 B2 and can improve the current balance compared with the circuit 100 in FIG. 1. By introducing a plurality of common-mode chokes 250A to 250(N−1), the driving circuit 200A may achieve lamp current balance effectively. Similarly, to prevent potential damages, a protection circuit 260 is included for sensing a short-circuit, open lamp or broken lamp condition. In FIG. 2A, the common-mode chokes 250A to 250(N−1) are respectively connected to the high voltage sides HV1 to HVN of the CCFLs and therefore these common-mode chokes may have a high cost and require extra attention in applications. To reduce the cost and exclude safety concerns, a circuit 200B is configured as represented in FIG. 2B, where the common-mode chokes 250A to 250(N−1) are respectively connected to the low voltage sides LV1 to LVN of the CCFLs.

Though the circuits in FIGS. 2A and 2B may provide a solution to lamp current balance, they fail to overcome the drawbacks relative to circuit protection. Additionally, those skilled in the art will recognize that with the configuration of the multiple transformers in FIG. 1, the currents flowing through the CCFLs may be readily sensed to adjust the brightness of the CCFLs. However, with the one transformer configuration, it is required to specially design a current sense circuit. Furthermore, if the number of the transformers in FIGS. 2A and 2B may be further reduced, significant cost savings will be achieved.

SUMMARY OF THE INVENTION

A disclosed circuit structure includes a transformer, a current balance circuit and electronic loads. The transformer is designed to ignite and run the electronic loads. The current balance circuit may be composed of chokes and coupled to low voltage sides of the electronic loads. The current balance circuit is designed to be able to balance current of N electronic loads by using N/2−1 chokes. The circuit structure may further include a protection circuit that is coupled to the low voltage side of the electronic loads for protecting the circuit structure from an open or broken lamp condition or a short-circuit condition.

BRIEF DESCRIPTION OF THE DRAWINGS

Advantages of the present invention will be apparent from the following detailed description of exemplary embodiments thereof, which description should be considered in conjunction with the accompanying drawings, in which:

FIG. 7 is a table of the lamp currents in FIG. 6.

DETAILED DESCRIPTION OF THE INVENTION

Reference will now be made in detail to embodiments of the present invention. While the invention will be described in conjunction with the embodiments, it will be understood that they are not intended to limit the invention to these embodiments. On the contrary, the invention is intended to cover alternatives, modifications and equivalents, which may be included within the spirit and scope of the invention as defined by the appended claims.

Figure 1:
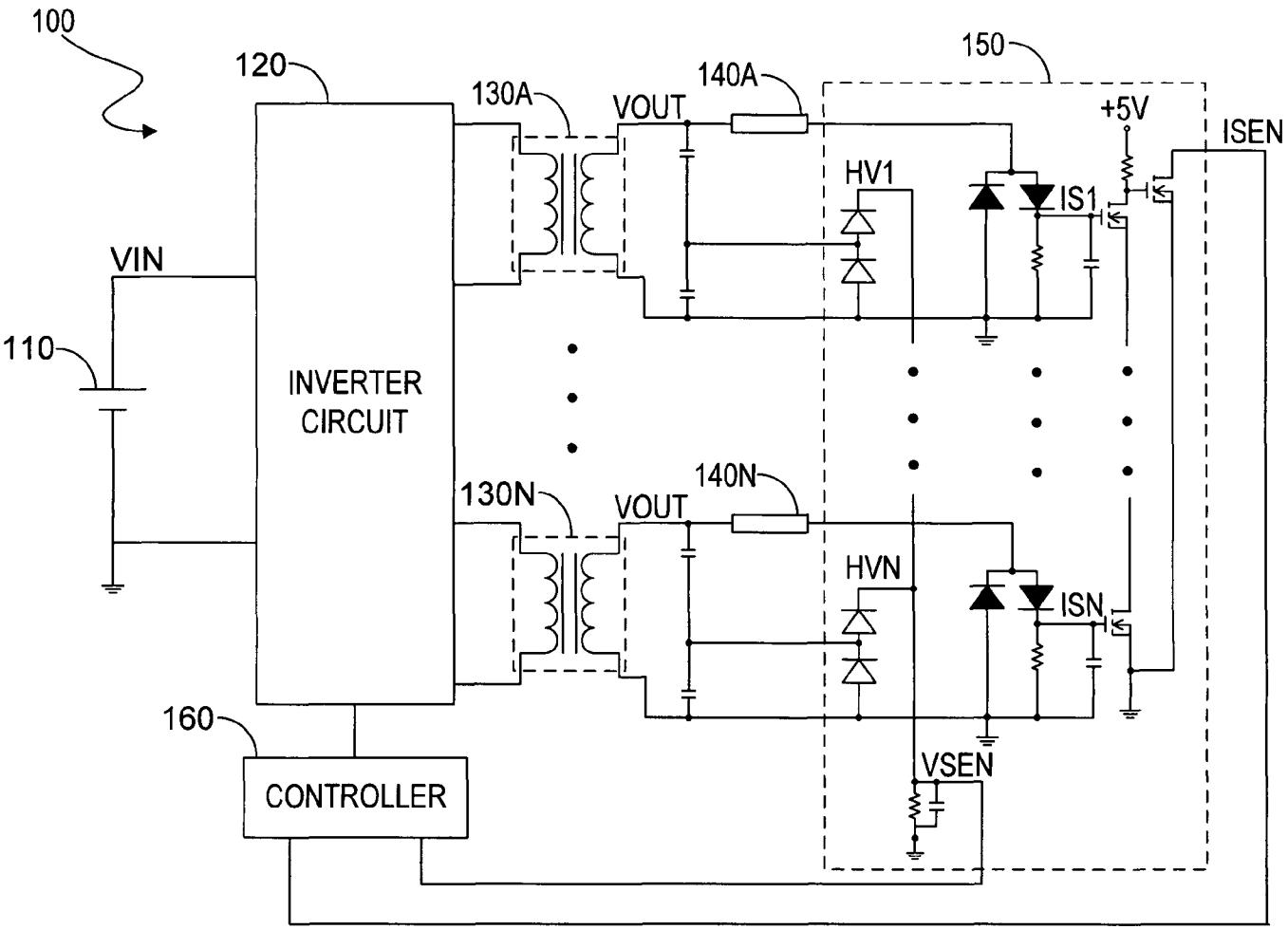
FIG. 1 PRIOR ART
FIG. 1 is a schematic diagram of a prior art circuit with a plurality of CCFLs.
Figure 2A:
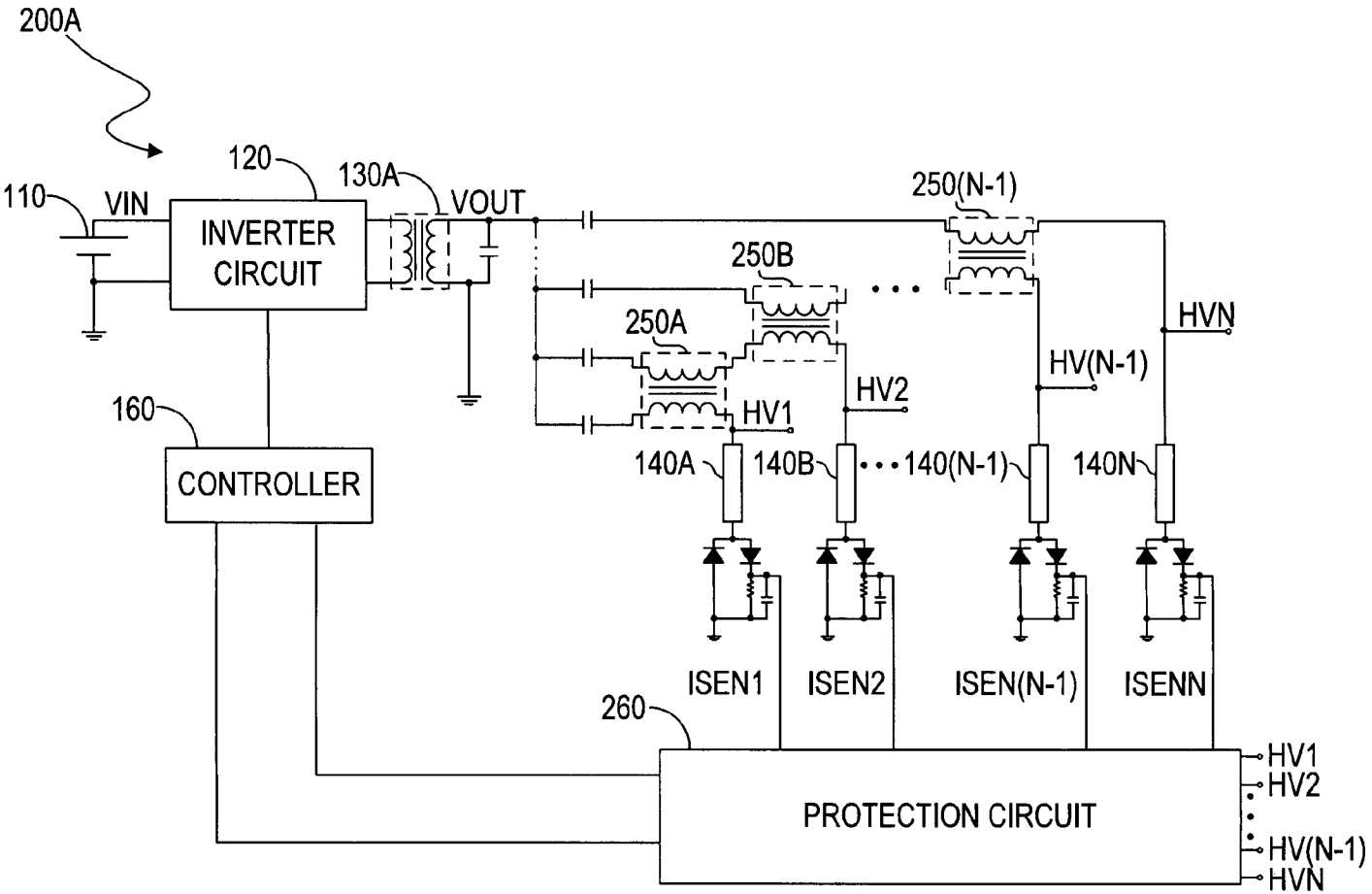
FIG. 2A PRIOR ART
FIG. 2A is a schematic diagram of another prior art circuit with a plurality of CCFLs.
Figure 2B:
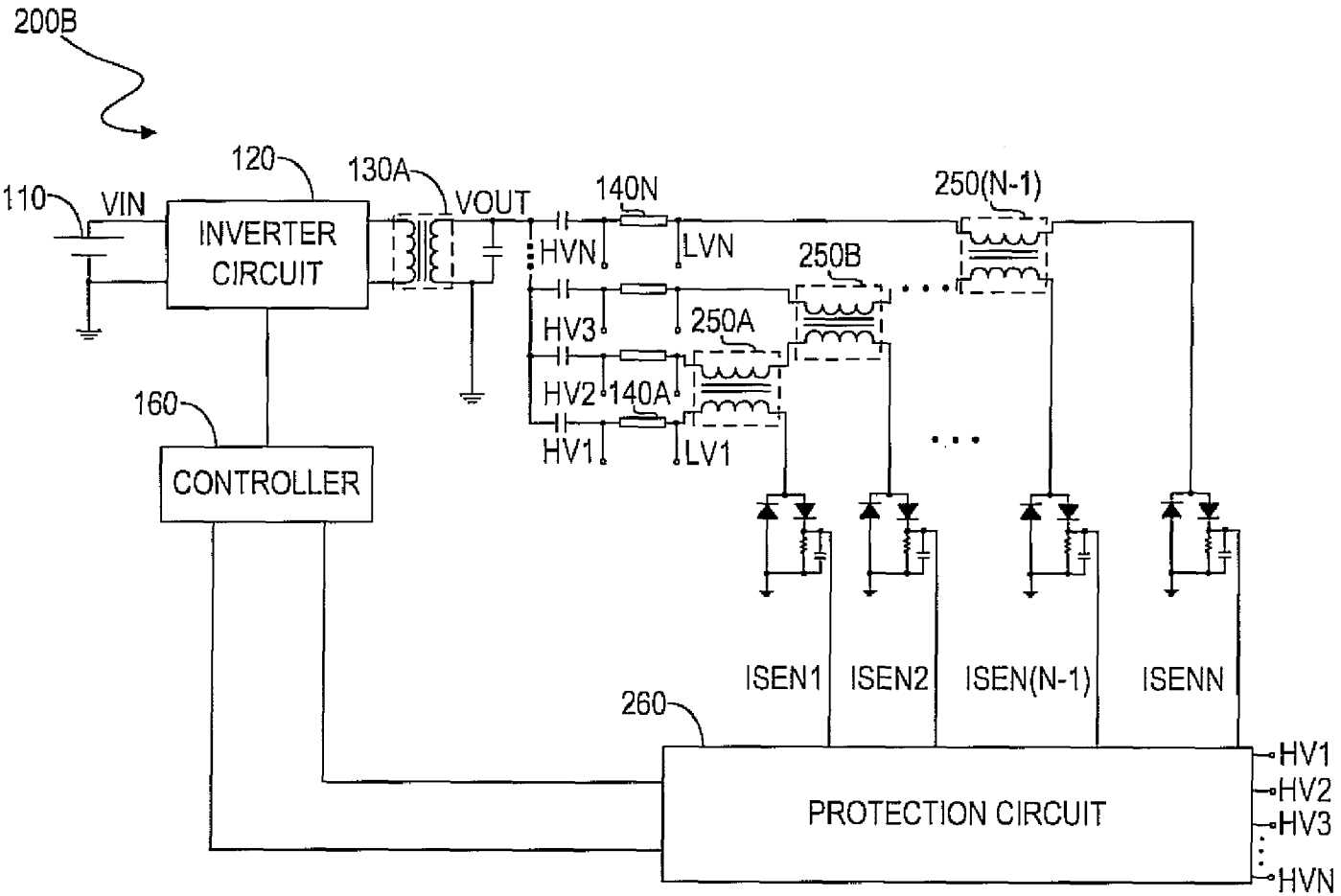
FIG. 2B PRIOR ART
FIG. 2B is a schematic diagram of another prior art circuit with a plurality of CCFLs.
Figure 3:
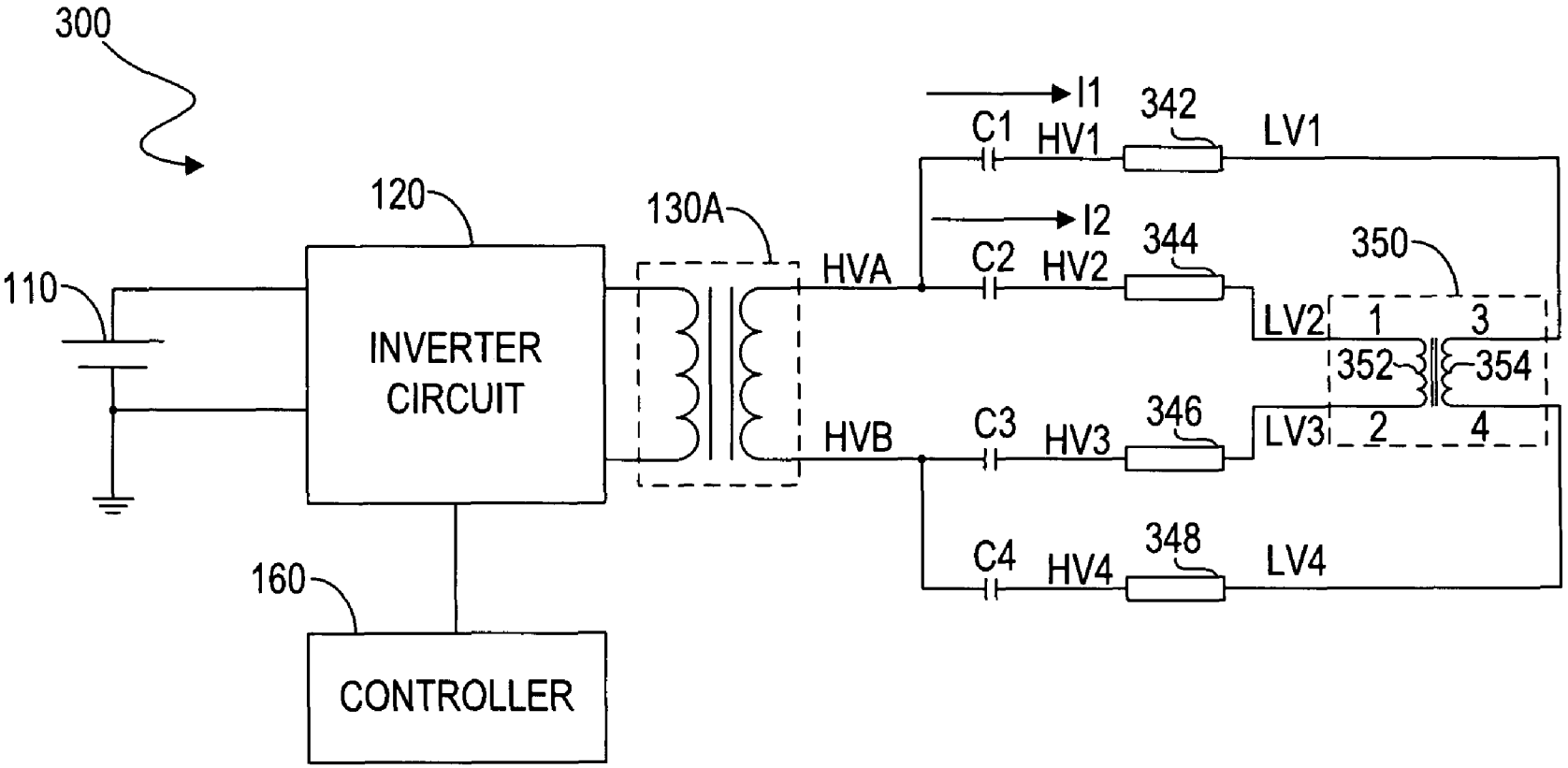
FIG. 3 is a schematic diagram of a circuit according to one embodiment of the present invention.

FIG. 3 illustrates a schematic diagram of a circuit 300 according to one embodiment of the present invention. The circuit 300 is used for driving CCFLs 342, 344, 346 and 348. Besides the DC power source 110, the inverter circuit 120, the transformer 130A and the controller 160, the circuit 300 further includes a current balance circuit consisting of a balance choke 350, typically a common-mode choke. The high voltage sides HV1 and HV2 of the CCFLs 342 and 344 are connected to the high voltage side HVA of the transformer 130A respectively through ballast capacitors C1 and C2. The high voltage sides HV3 and HV4 of the CCFLs 346 and 348 are connected to the high voltage side HVB of the transformer 130A respectively through ballast capacitors C3 and C4. The balance choke 350 is connected to the low voltage sides LV1 to LV4 of the CCFLs. The low voltage sides LV2 and LV3 of the CCFLs 344 and 346 are respectively connected to terminals 1 and 2 of a first winding 352 of the balance choke 350. The low voltage sides LV1 and LV4 of the CCFLs 342 and 348 are respectively connected to terminals 3 and 4 of a second winding 354 of the balance choke 350. Theoretically, currents of the series CCFLs 342 and 348 are equal and currents of the series CCFLs 344 and 346 are equal. Herein, I1 is defined as the current of the CCFL 342 or 348 and I2 is defined as the current of the CCFL 344 or 346. When the first and second windings 352 and 354 have equal turns and reversed polarity, the current I1 will be equal to the current I2 and consequently current balance of the CCFLs 342 to 348 is achieved.

Figure 4:
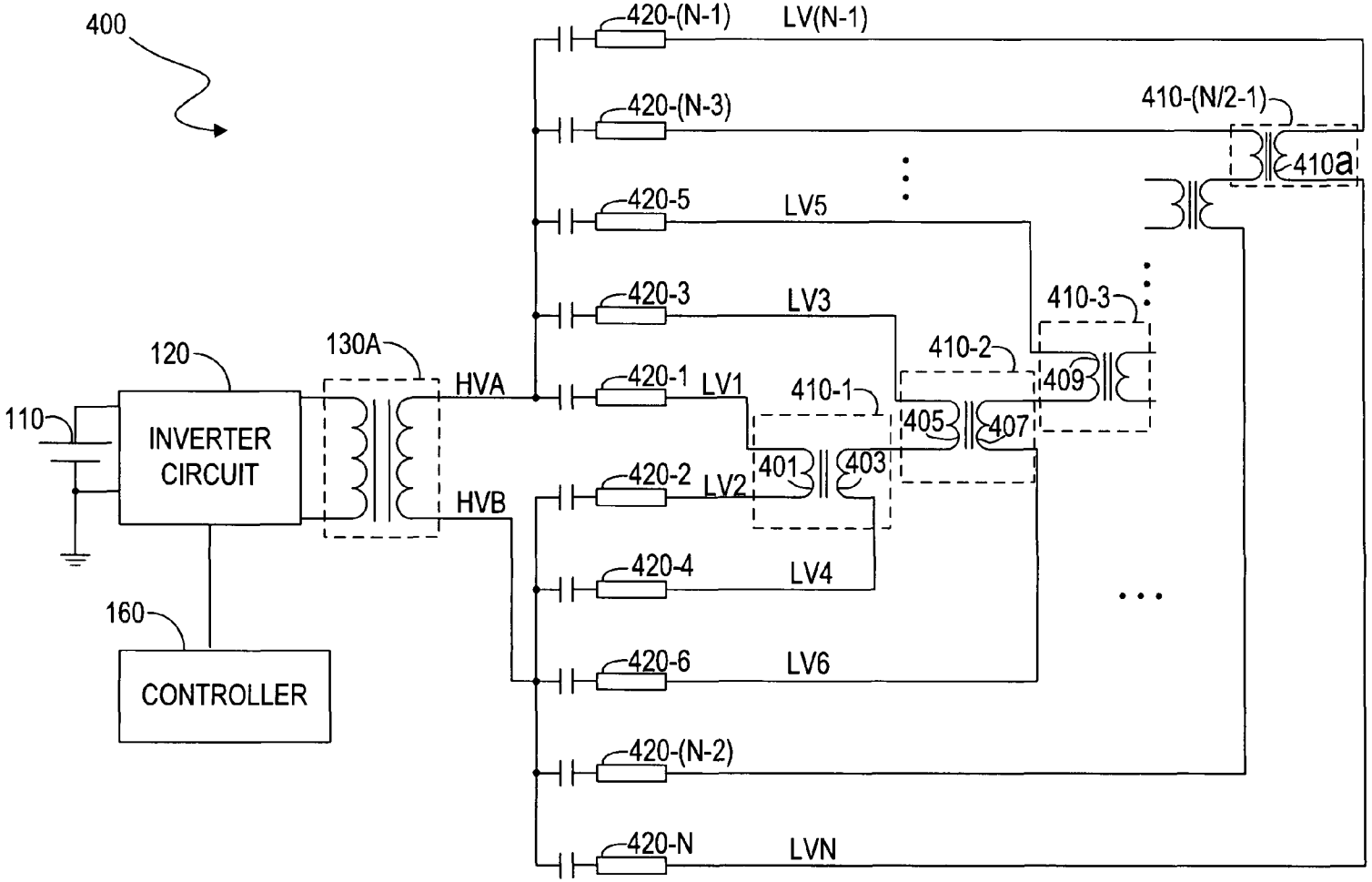
FIG. 4 is a schematic diagram of a circuit according to another embodiment of the present invention.

The circuit 300 may be extended to a circuit 400 with a plurality of CCFLs 420-1 to 420-N as depicted in FIG. 4. Totally, the current balance circuit in the circuit 400 requires only N/2−1 balance chokes connected to the low voltage sides LV1 to LVN of the CCFLs 420-1 to 420-N, where N is defined as an even integer, such as 4, 6, 8, 10 . . . . As depicted in FIG. 4, a first winding 401 of the balance choke 410-1 is connected between CCFLs 420-1 and 420-2. A second winding 403 of the balance choke 410-1 is connected to a first winding 405 of a next adjacent balance choke 410-2. The second and first windings 403 and 405 are further connected between CCFLs 420-3 and 420-4. Similarly, a second winding 407 of the balance choke 410-2 is connected in series with a first winding 409 of a next adjacent balance choke 410-3. The second and first windings 407 and 409 are further connected between CCFLs 420-5 and 420-6. Sequentially, adjacent balance chokes are all connected in this way until a second winding 410*a* of the balance choke 410-(N/2−1) is connected between CCFLs 420-(N−1) and 420-N.

Compared to conventional circuitries, the number of the balance chokes in FIG. 4 is reduced significantly. Additionally, since the balance chokes are connected to the low voltage sides of the CCFLs, expensive transformers capable of enduring a high voltage are not necessitated and consequently overall cost is further reduced. Furthermore, when connecting the balance chokes to the low voltage sides, operators need not pay extra attention to potential damages, such as arcing, hazard and the like.

Those skilled in the art will recognize that the ballast capacitors in FIGS. 3 and 4 may help ignite the CCFLs but these ballast capacitors are not necessitated in these embodiments. In applications, the CCFLs may be directly connected to the high voltages sides HVA and HVB of the transformer 130A. Also, those skilled in the art will recognize that the plurality of balance chokes 410-1 to 410-(N/2−1) may be transformers constructed with a Molybdenum Permalloy Powder (MPP) Core, Micrometal Powder Iron Core, Ferrite EE-Core, Pot-Core, or Toroid Core.

Figure 5A:
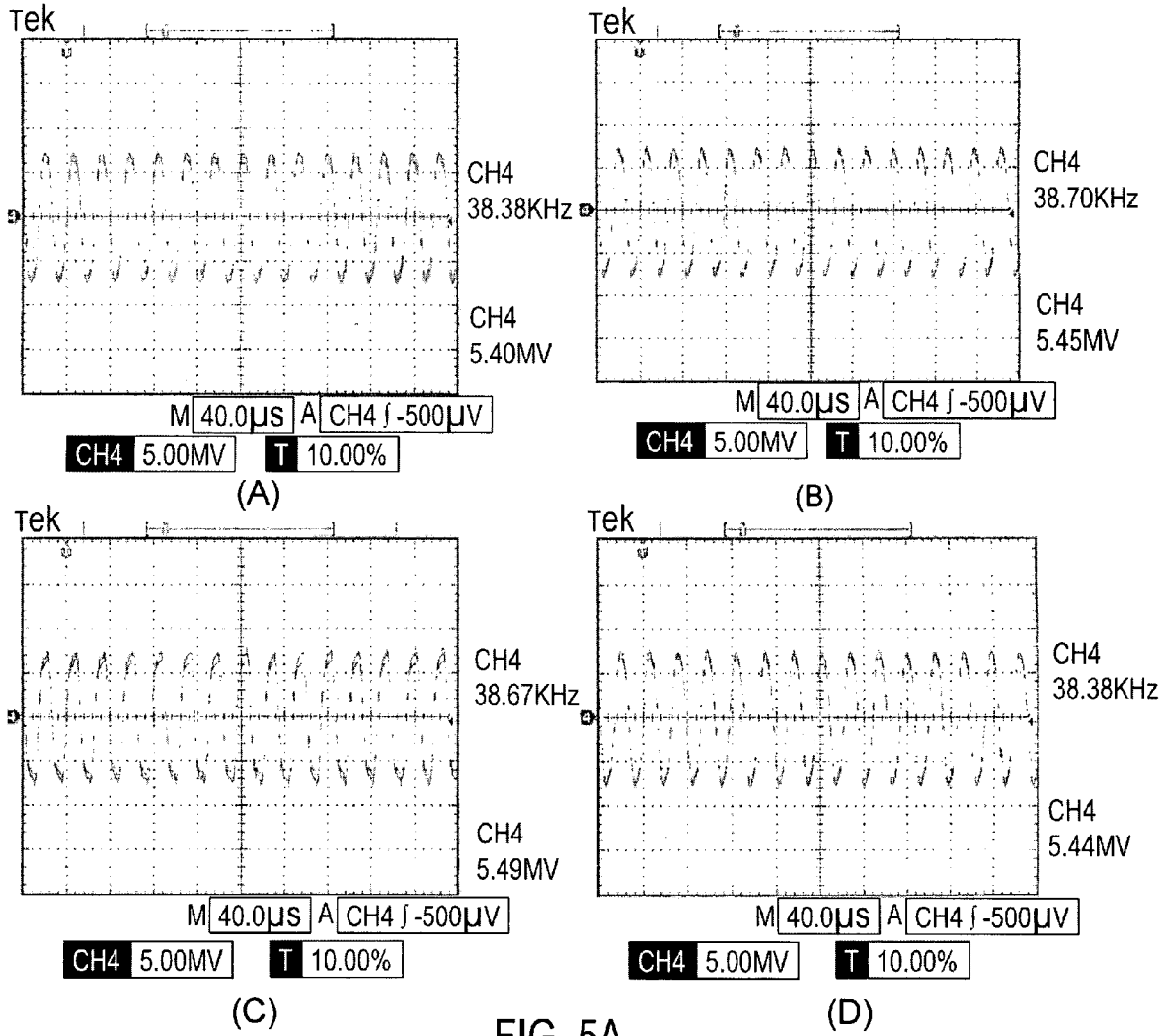
FIG. 5A is a diagram depicting experiment waveforms of lamp currents in FIG. 3.

FIG. 5A illustrates experimental waveforms of the lamp currents flowing through the CCFLs in FIG. 3. Plots (A) to (D) respectively represent lamp currents of the CCFLs 342 to 348. In the experiment, the inductance of the balance choke 350 is set to be 300 millinery (mH) and an iron core of the balance choke 350 is made of EE10 core. It can be observed that the tested lamp currents of the CCFLs 342 to 348 are respectively equal to 5.40 mA, 5.45 mA, 5.49 mA, and 5.44 mA. Current deviations are kept within 0.1 mA and thus excellent current balancing is achieved.

Figure 5B:
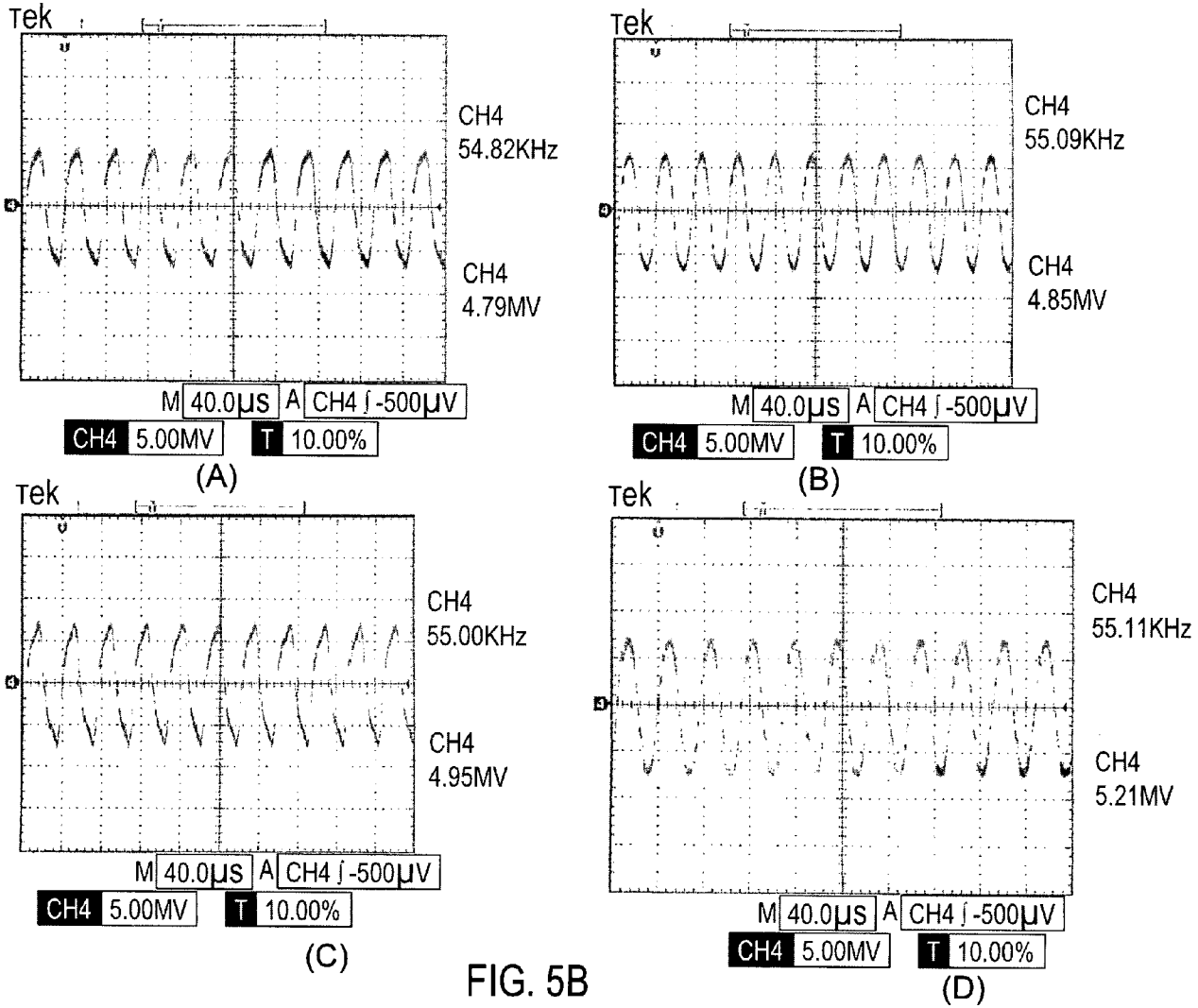
FIGS. 5B and 5C are diagrams depicting experiment waveforms of lamp currents in FIG. 4.
Figure 5C:
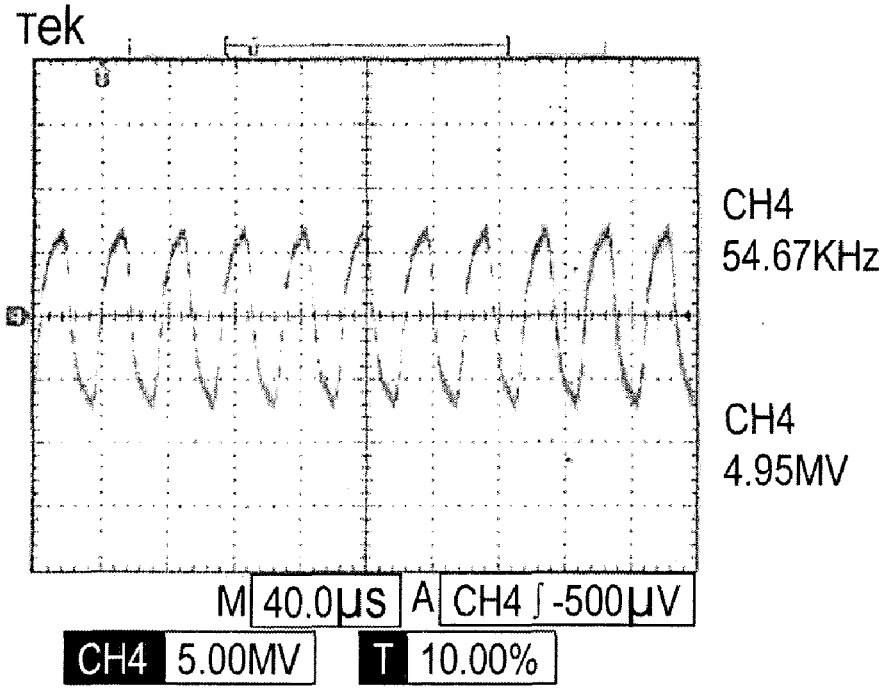
Figure 5C:
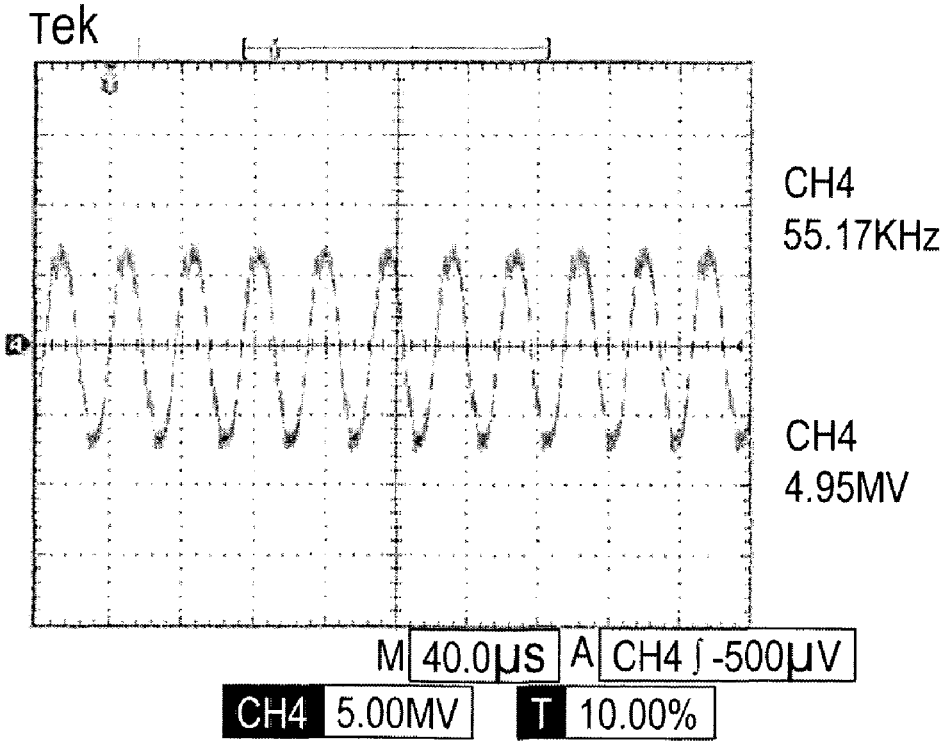

Assuming the integer N in FIG. 4 is equal to 6, the experimental waveforms of the lamp currents flowing through the CCFLs 420-1 to 420-6 are illustrated in FIGS. 5B and 5C. Plots (A) to (F) respectively represent lamp currents of the CCFLs 420-1 to 420-6. In the experiment, the inductance of the balance tranformers 410-1 and 410-2 is set to be 250 millinery (mH) and an iron core of the balance tranformers 410-1 and 410-2 is made of EE8.3 core. It can be observed that the tested lamp currents of the CCFLs 420-1 to 420-6 are respectively equal to 4.79 mA, 4.85 mA, 4.95 mA, 5.21 mA, 4.95 mA, and 4.95 mA. Current deviations are kept within 0.3 mA and thus excellent current balancing is achieved.

Figure 6:
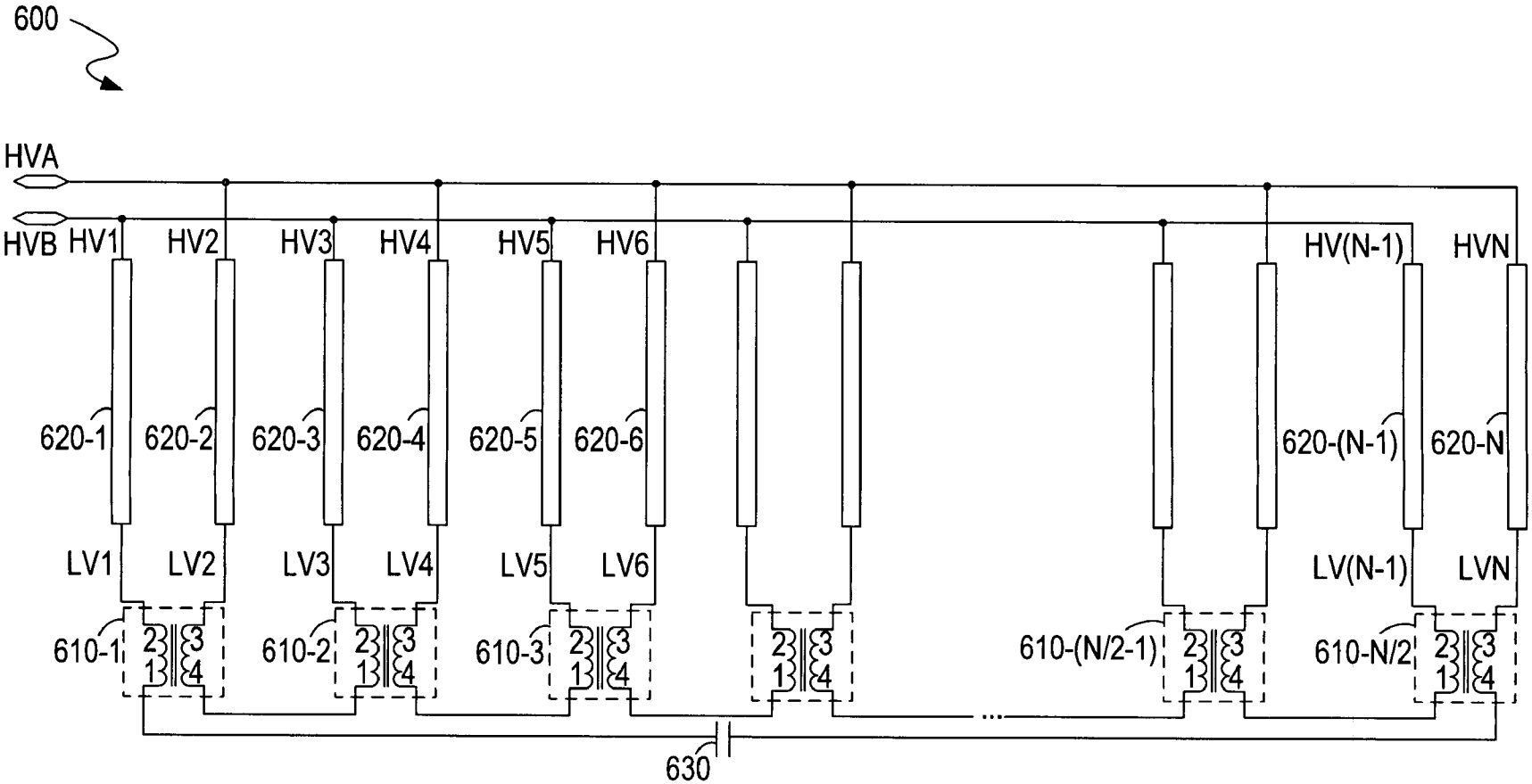
FIG. 6 is a schematic diagram of a circuit according to another embodiment of the present invention.

FIG. 6 illustrates a schematic diagram of a circuit structure 600 with a plurality of CCFLs 620-1 to 620-N according to another embodiment of the present invention. For clarity, identical elements that appear in FIG. 4 are omitted herein and only the difference is highlighted. Referring to FIG. 6, the high voltage sides HV1, HV3, HV5 to HV(N−1) of the odd-numbered CCFLs 620-1, 620-3, 620-5, to 620-(N−1) are connected to the high voltage side HVB of the transformer 130A shown in FIG. 4. The high voltages sides HV2, HV4, HV6 to HVN of the even-numbered CCFLs 620-2, 620-4, 620-6, to 620-N are connected to the high voltage side HVA of the transformer 130A. The low voltage sides of adjacent CCFLs, for example the low voltage sides LV1 and LV2, LV3 and LV4, to LV(N−1) and LVN, are connected to a balance choke in the current balance circuit. To realize the current balance of the CCFLs 620-1 to 620-N, the circuit 600 totally requires N/2 balance chokes 610-1 to 610-N/2 in the current balance circuit in which N is no less than 4.

Each balance choke has a first winding with terminals 1 and 2 and a second winding with terminals 3 and 4. The terminals 2 and 3 of each balance choke are connected respectively to the low voltage sides of the connected CCFLs. For example, the terminals 2 and 3 of the balance choke 610-1 are respectively connected the low voltages sides LV1 and LV2 of the CCFLs 620-1 and 620-2, and the terminals 2 and 3 of the balance choke 610-N/2 are respectively connected the low voltages sides LV(N−1) and LVN of the CCFLs 620-(N−1) and 620-N. The terminal 4 of each balance choke is connected to the terminal 1 of the next adjacent balance choke. For example, the terminal 4 of the balance choke 610-1 is connected to the terminal 1 of the balance choke 610-2, and the terminal 4 of the balance choke 610-2 is further connected to the terminal 1 of the balance choke 610-3. Similarly, the terminal 4 of the balance choke 610-(N/2−1) is eventually connected to the terminal 1 of the balance choke 610-N/2, and the terminal 4 of the balance choke 610-N/2 is connected back to the terminal 1 of the balance choke 610-1. Additionally, a capacitor 630 may be connected between the terminal 4 of the balance choke 610-N/2 and the terminal 1 of the balance choke 610-1.

FIG. 7 illustrates a table of the lamp currents tested according to an experiment on the circuit in FIG. 6. The experimental circuit is for driving 12 CCFLs, CCFL1 to CCFL12, which provide the backlight to a 30-inch LCD panel. The operating frequency of the experimental circuit is 55 KHz. It can be observed that when the root mean square value (RMS) of lamp current is set to be a first value 4 mArms, the deviation of the currents flowing through the CCFL1 to CCFL12 is within +/−0.25 mA. When the RMS value is set to be a second value 6 mArms, the deviation of the currents flowing through the CCFL1 to CCFL12 is within +/−0.25 mA, and when the RMS value is set to be a third value 8 mArms, the deviation of the currents flowing through the CCFL1 to CCFL12 is within +/−0.17 mA. Thus, it can be concluded that when driven by the circuit in FIG. 6, the multiple CCFLs may realize good current balance and consequently the LCD panel backlighted by these CCFLs may gain even brightness.

Figure 8A:
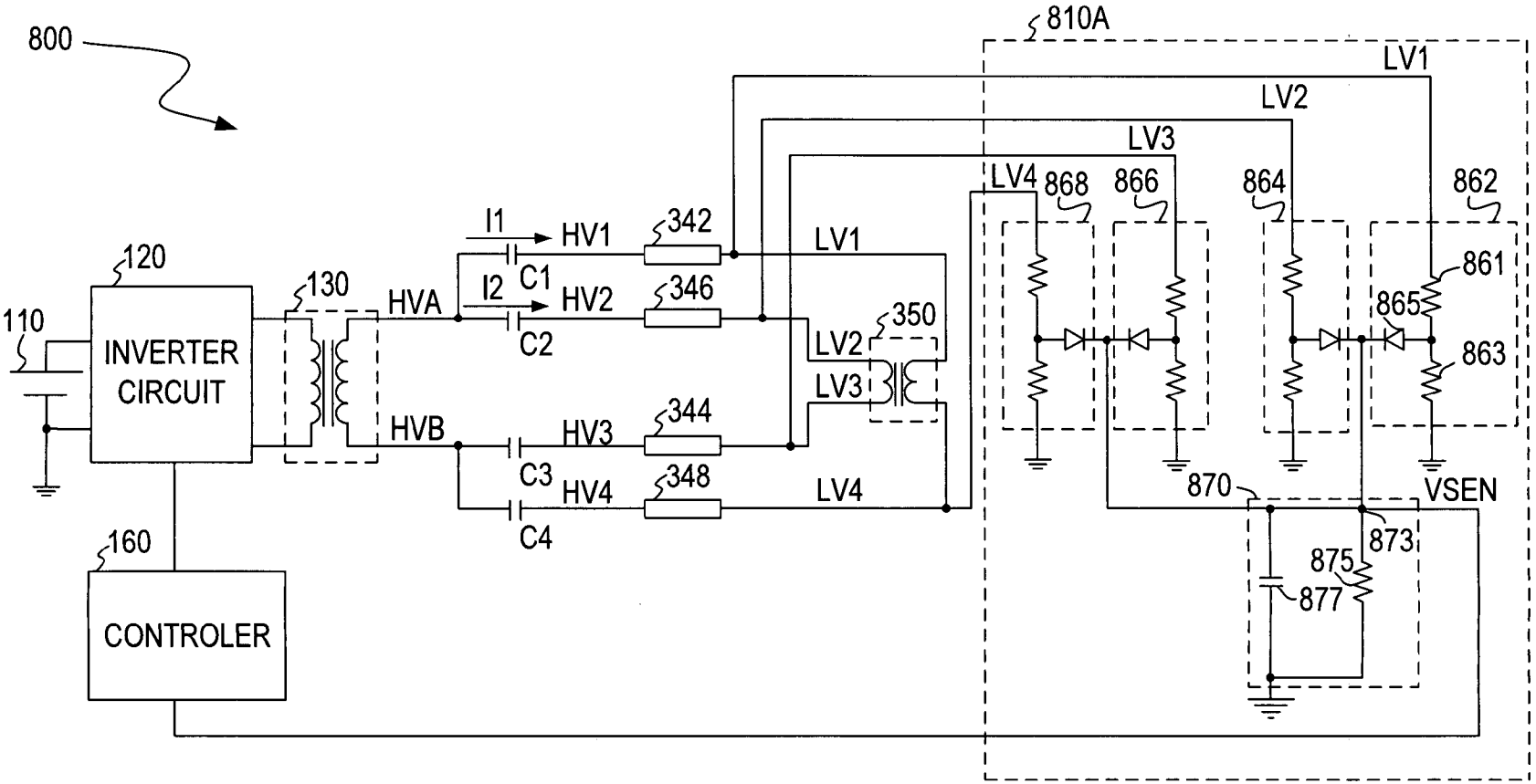
FIG. 8A is a schematic diagram of a circuit according to another embodiment of the present invention.

FIG. 8A illustrates a schematic diagram of a circuit 800 according to another embodiment of the present invention. Compared to the circuit in FIG. 3, the circuit 800 further includes a protection circuit 810A, which is capable of sensing an abnormal condition, for example, an open or broken lamp condition and a short-circuit condition. The protection circuit 810A senses the abnormal condition by detecting the low side voltages of the CCFLs and then provides a voltage feedback signal VSEN to the controller 160. In response to the received voltage feedback signal VSEN, the controller 160 may identify the abnormal condition and then take corresponding actions to prevent damages.

Referring to FIG. 8A, the protection circuit 810A is composed of voltage sensing circuits 862, 864, 866 and 868, and a RC circuit 870. The voltage sensing circuits 862 to 868 are connected respectively to the low voltage sides LV1 to LV4 of the CCFLs. Meanwhile, all voltage sensing circuits 862 to 868 are further connected to the RC circuit 870 at a node 873. The RC circuit 870 includes a resistor 875 and a capacitor 877 that are connected in parallel between the node 873 and the ground. Each voltage sensing circuit is further composed of series resistors and a diode. For example, the current sensing circuit 862 includes a first resistor 861, a second resistor 863 and a diode 865. The first and second resistors 861 and 863 are connected in series between the low side voltage LV1 and the ground. The anode of the diode 865 is connected to a junction node of the first and second resistors 861 and 863. The cathode of the diode 865 is connected to the RC circuit 870 at the node 873. The voltage sensing circuit 862 may sense the voltage of the low voltage side LV1 timely. In the similar method, voltage sensing circuits 864, 866 and 868 are configured for respectively sensing the voltages of the low voltage sides LV2 to LV4. Based on the sensed voltages, the voltage feedback signal VSEN is produced at the node 873 and then fed to the controller 160.

If there exists an abnormal condition, the controller 160 may identify the abnormal condition as an open or broken lamp condition or a short-circuit condition in response to the voltage sense signal VSEN. Through the following analysis, this feature will be understood by those skilled in the art. In normal operation, the low side voltage of each lamp is approximately zero volt, for example $V_{LV1}$ is equal to 0V, where $V_{LV1}$ is defined as the voltage of the low voltage side LV1. If there is an open or broken lamp condition, for example the CCFL 342 is removed, broken or fails to ignite, the normal current I1 that originally flows through the CCFLs 342 and 348 will be decreased to a current I1' and the low side voltage $V_{LV1}$ will increase significantly. The low side voltage $V_{LV1}$ may be given by an equation (1).

$$V_{LV1} = V_{HVA} + \frac{jI1'}{\varpi C} + j\varpi L(I2 - I1') - R_{LA} * I1' \tag{1}$$

Where $V_{HVA}$ is defined as the voltage at the high voltage side HVA, C is defined as the capacitance of the ballast capacitor C1, L is defined as the inductance of the balance choke 350 and $R_{LA}$ is defined as the resistance of the CCFL 348. Because the current I1' is much lower than the normal current I1, the resultant $V_{LV1}$ will be increased greatly. Thus, the protection circuit 810A may sense the voltage increase at the low voltage side LV1 caused by the open or broken lamp condition and the controller 160 may take an immediate action to prevent damages. In the similar way, the protection circuit 810A may detect the open or broken lamp condition happening to other CCFLs.

If one of the high side voltages HV1 to HV4 is shorted to the ground, for example, the high side voltage HV1 is shorted to the ground, then the normal current I1 will decrease dramatically to I1" and the low side voltage $V_{LV1}$ will change accordingly. The low side voltage $V_{LV1}$ is given by an equation (2).

$$V_{LV1} \approx \frac{V_{HVB} + \frac{jI1''}{\varpi C} + j\varpi L(I2 - I1'')}{2} \tag{2}$$

Where $V_{HVB}$ is defined as the voltage at the high voltage side HVB. The protection circuit 810A sends the sensed voltage change to the controller 160, which in turn takes an immediate action to prevent damages caused by the short-circuit condition. If one of the high side voltages HV1 to HV4 is shorted to the corresponding low side voltage, for example, the HV1 is shorted to the LV1, the normal current I1 will increase dramatically to I1''' and the low side voltage $V_{LV1}$ will change accordingly. The low side voltage $V_{LV1}$ is given by equation (3).

$$V_{LV1} \approx \frac{I1''' * R_{RLA} + j\varpi L(I1''' - I2)}{2} \quad (3)$$

Again, the protection circuit 810A sends the sensed voltage change to the controller 160, which in turn takes an immediate action to prevent damages caused by the short-circuit condition. In the similar way, the protection circuit 810A may detect the short-circuit condition happening to other CCFLs.

Figure 8B:
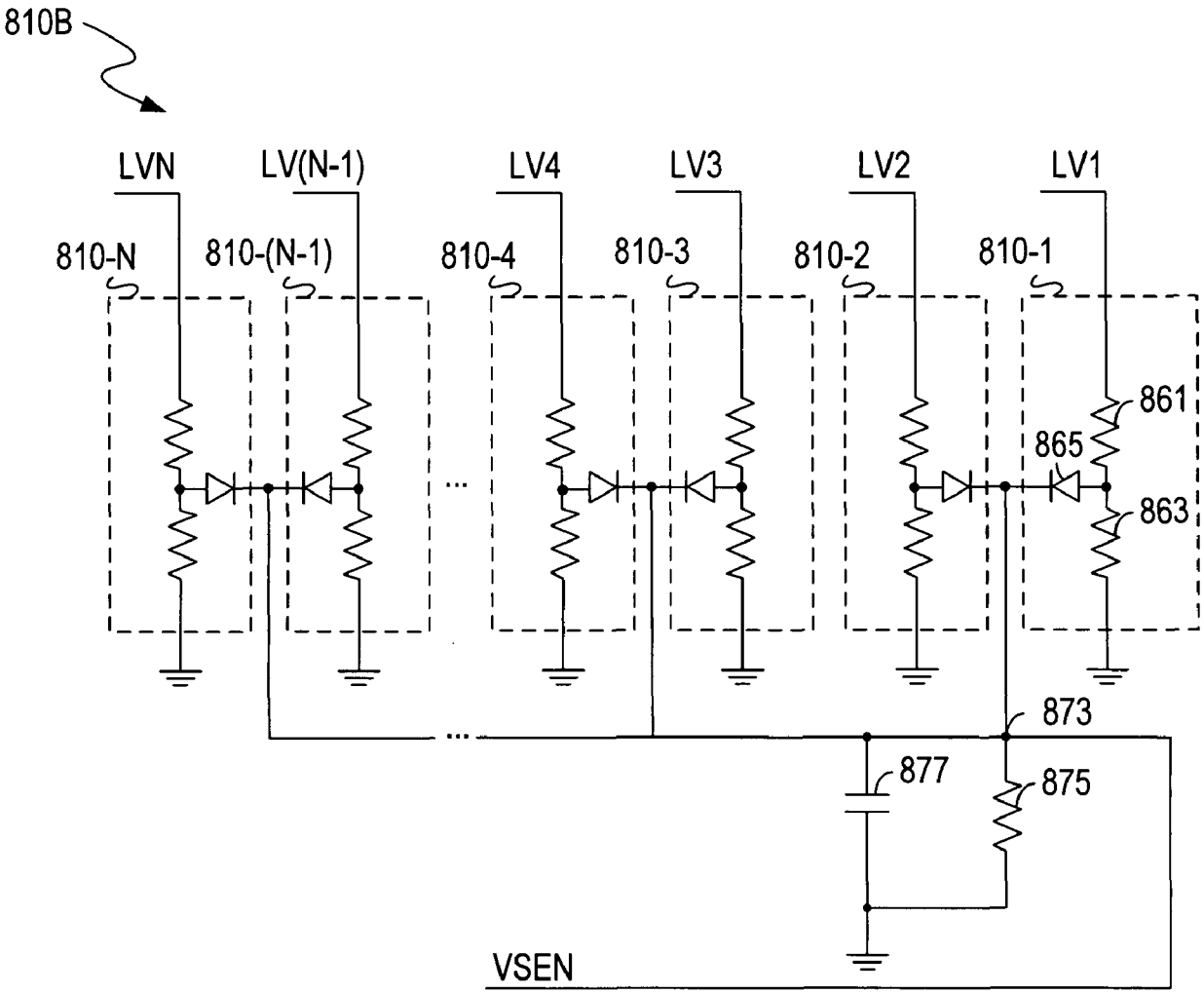
FIG. 8B is a schematic diagram of a circuit according to another embodiment of the present invention.

Those skilled in the art will recognize that the protection circuit 810A may be extended to a circuit 810B as represented in FIG. 8B, which is used to protect the circuit structure 400 as represented in FIG. 4 from an open lamp or short-circuit condition. The low voltage sides LV1 to LVN of the CCFLs in FIG. 4 are connected respectively to voltage sensing circuits 810-1 to 810-N. Based on the low side voltages sensed by the voltage sensing circuit 810-1 to 810-N, the voltage feedback signal VSEN is produced at the node 873 and then fed to the controller 160 in FIG. 4.

Those skilled in the art will recognize that compared to conventional protection circuits, the protection circuit depicted herein is composed of cost-competitive elements and meanwhile element count is reduced significantly. Thus, cost and size savings are achieved. Additionally, the protection circuit depicted herein is connected to the low voltage sides of the CCFLs and therefore no extra attention is required on acring or other potential hazard. Additionally, implementation of the protection circuit is not limited to the circuits in FIGS. 4 and 6. Actually, those skilled in the art will recognize the protection circuit depicted herein may be applied to various backlight circuit structures where at least one balance choke is connected to the low voltage sides of the backlight lamps.

Figure 9:
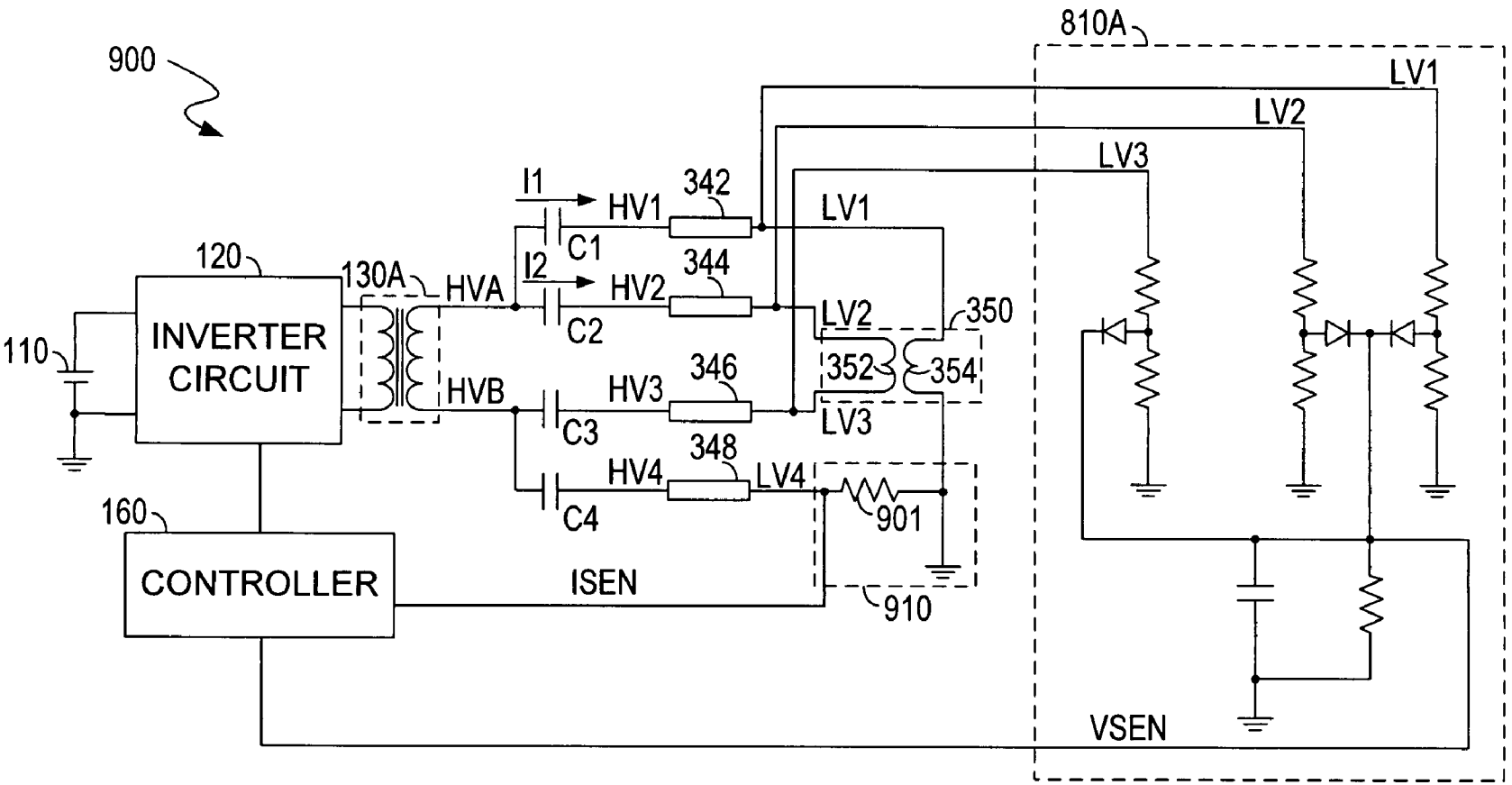
FIG. 9 is a schematic diagram of a circuit according to another embodiment of the present invention.

FIG. 9 illustrates a schematic diagram of a circuit structure 900 with a plurality of CCFLs according to another embodiment of the present invention. Compared to the circuit in FIG. 8A, the circuit 900 further includes a current sense circuit 910 consisting of a current sense resistor 901. As represented in FIG. 9, the current sense resistor 901 is connected between the CCFL 348 and the second winding 354 of the balance choke 350. A junction node of the current sense resistor 901 and the second winding 354 is further tied to the ground. At a junction node between the current sense resistor 901 and the CCFL 348, a current feedback signal ISEN is derived and fed to the controller 160. In response to the current feedback signal ISEN, the controller 160 may adjust the lamp currents and consequently regulate the lamp brightness. Therefore, a tight control over lamp brightness is achieved. Additionally, it should be noted that the voltage sensing circuit 868 in FIG. 8A is eliminated since affected by the current sense resistor 901, the low side voltage LV4 is pulled down to a low voltage and no longer an indication of the abnormal condition, e.g., open or broken lamp condition, or short-circuit condition.

In practice, a current sense voltage indicative of the current flowing through the CCFLs 342 and 348 develops across the current sense resistor 901 and is inputted into the controller 160 as the current feedback signal ISEN. In response to the current feedback signal ISEN, the controller 160 adjusts the current flowing through the CCFLs and therefore the brightness of the CCFLs.

Those skilled in the art will recognize the current sense circuit 910 is not necessarily located between the CCFL 348 and the second winding 354. There may be other possible configurations, for example, the current sense circuit 910 is located between the CCFL 342 and the second winding 354. Additionally, the current sense circuit 910 may be applied to the circuit structure with a plurality of CCFLs in FIG. 4 in the same method.

Figure 10:
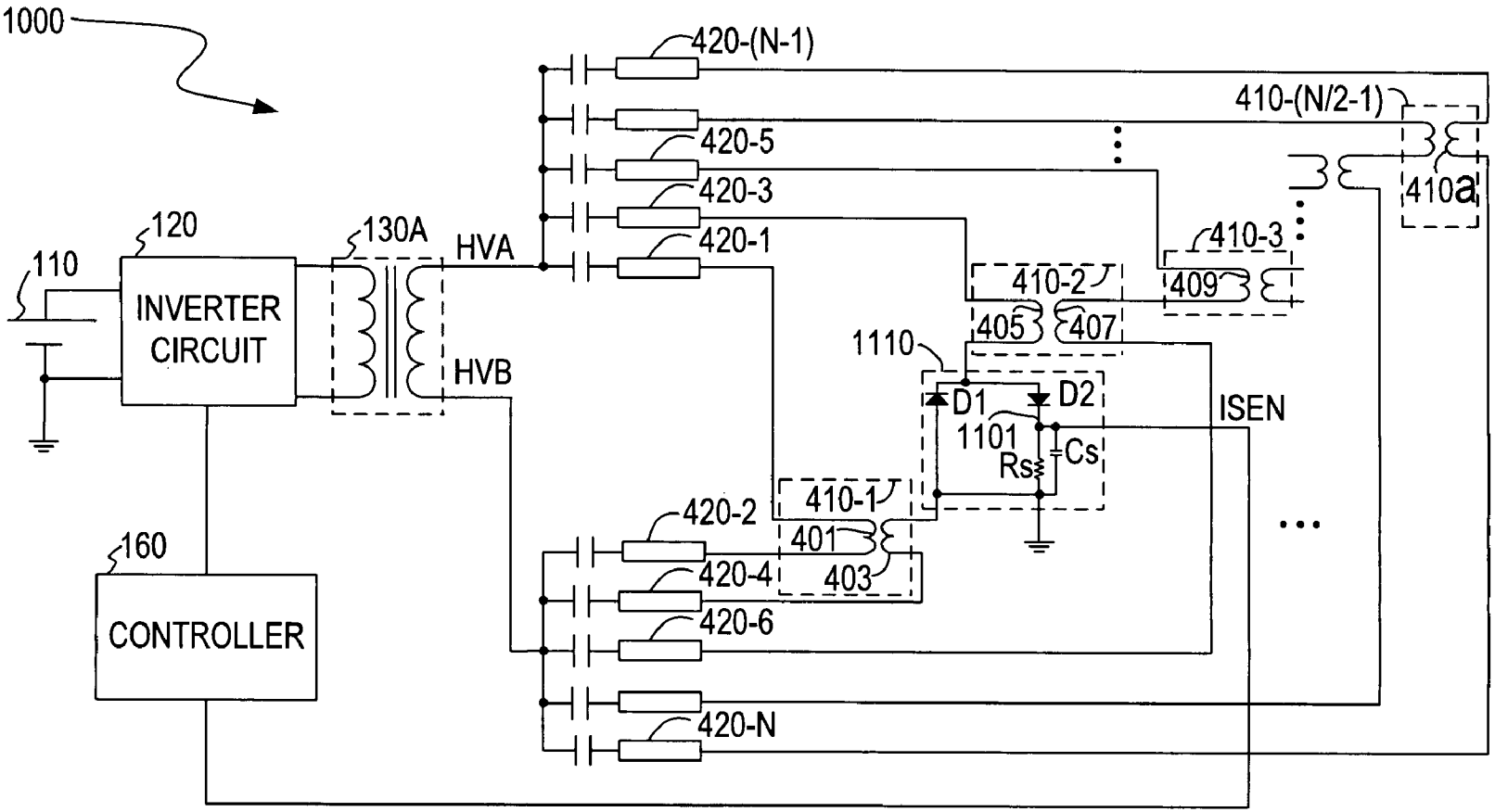
FIG. 10 is a schematic diagram of a circuit according to another embodiment of the present invention.

FIG. 10 illustrates a schematic diagram of a circuit 1000 with a plurality of CCFLs according to another embodiment of the present invention. Compared to the circuit in FIG. 4, a current sense circuit 1110 is connected between the second winding 403 of the balance choke 410-1 and the first winding 405 of the balance choke 410-2. The current sense circuit 1110 is composed of a first diode D1, a second diode D2, a current sense resistor Rs and a capacitor Cs. The anode of the first diode D1 is connected to the terminal 3 of the second winding 403 and the cathode of the first diode D1 is connected to the terminal 2 of the first winding 405. The anode of the second diode D2 is connected to the terminal 2 of the first winding 405 and thus the second diode D2 is reverse biased relative to the first diode D1. The cathode of the second diode D2 is connected to terminal 3 of the second winding 403 through the current sense resistor Rs. The current sense resistor Rs is further connected in parallel with the capacitor Cs. Furthermore, terminal 3 of the second winding 403 is tied to the ground. At a junction node 1101 of the second diode D2 and the current sense resistor Rs, the current feedback signal ISEN is produced and fed to the controller 160.

In practice, a current sense voltage indicative of the current flowing through the CCFLs 420-3 and 420-4 develops across the current sense resistor Rs and the capacitor Cs and is inputted into the controller 160 as the current feedback signal ISEN. In response to the current feedback signal ISEN, the controller 160 adjusts the current flowing through the CCFLs and therefore the brightness of the CCFLs.

Those skilled in the art will recognize that it is not necessitated to connect the current sense circuit 1110 between the balance chokes 410-1 and 410-2. Instead, the current sense circuit 1110 may be located between arbitrary two adjacent balance chokes from 410-1 to 410-(N/2−1). Additionally, the protection circuit 810B in FIG. 8B may be included to protect the circuit 1000 from an open or broken lamp condition or a short-circuit condition.

In operation, a circuit structure may include an inverter topology, a plurality of loads, e.g. CCFLs, connected to the inverter topology for providing illumination for LCD panels, a current balance circuit consisting of at least one balance choke connected to the plurality of loads for balancing the lamp currents. At least two loads of the plurality of loads are connected in series through one of the at least one balance choke. At least four loads of the plurality of loads are connected to one of the at least one balance choke for realizing current balance of the at least four loads. The at least one balance choke is connected consecutively to each other to realize current balance of the plurality of loads.

Furthermore, the circuit structure may include a protection circuit connected to the low voltage sides of the plurality of loads. The protection circuit is capable of protecting the circuit structure from the open or broken lamp condition or the short-circuit condition. Moreover, the circuit structure may include a current sense circuit which is used for tight control over current brightness.

Those skilled in the art that the circuit structure disclosed herein may be applied to various inverter topologies including the Royer, the full bridge, the half bridge, the push-pull, and the class D. Additionally, the controller may adopt various dimming control methods including the analog control, the pulse width modulation (PWM) control and the mixed control. Those skilled in the art will recognize all these modifications are within the scope of the claims.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Other modifications, variations, and alternatives are also possible. Accordingly, the claims are intended to cover all such equivalents.

What is claimed is:

1. A circuit comprising:

a power source;

a transformer coupled to said power source;

a plurality of loads, including a first through an $N^{th}$ load wherein N is an even integer and at least 4, said plurality of loads having a high voltage side and a low voltage side, and wherein said transformer is coupled with said high voltage side of said plurality of loads, wherein said loads are arranged as a plurality of series-coupled load pairs, and wherein a plurality of load currents are generated to flow through said series-coupled load pairs;

a current balance circuit having at least one balance choke including a first winding and a second winding, wherein said first winding of said at least one balance choke is coupled in series with said low voltage side of said first load and said low voltage side of a second load of said series-coupled load pairs, and said second winding of said at least one balance choke is coupled in series with said low voltage sides of an $N-1^{th}$ load and said $N^{th}$ load of said series-coupled load pairs, said current balance circuit useful for balancing said load currents; and a current sense circuit coupled between said low voltage side of a load of said series-coupled load pair and said at least one balance choke, and operable for generating a feedback signal indicative of a corresponding load current flowing through said series-coupled load pair.

2. The circuit of claim 1, wherein N is at least 6 and wherein said current balance circuit at least one balance choke includes only a first through an $((N/2)-1)^{th}$ balance chokes, and wherein said balance chokes each includes a first winding and a second winding, wherein said first winding of said first balance choke is coupled in series with said low voltage side of said first load and said low voltage side of said second load, and said first winding of a $(K+1)^{th}$ balance choke is coupled in series with said second winding of a $K^{th}$ balance choke, said low voltage side of a $(2K+1)^{th}$ load and said low voltage side of a $(2K+2)^{th}$ load, where $K=(N/2)-2$.

3. The circuit of claim 1, wherein N is at least 6 and wherein said current balance circuit includes only a first through an $(N/2)^{th}$ balance chokes, and wherein said balance chokes each includes a first winding and a second winding, wherein said first winding of said first balance choke is coupled in series with said second winding of said $(N/2)^{th}$ balance choke, said low voltage side of said first load and said low voltage side of said $N^{th}$ load, and said first winding of a $(K+1)^{th}$ balance choke is coupled in series with said second winding of a $K^{th}$ balance choke, said low voltage side of a $(2K+1)^{th}$ load and said low voltage side of a $(2K)^{th}$ load, where $K=(N/2)-1$.

4. The circuit of claim 1, wherein said current sense circuit is grounded.

5. The circuit of claim 1, wherein said loads comprise cold cathode fluorescent lamps (CCFLs).

6. The circuit of claim 1, further comprising:

a plurality of capacitors coupled between said transformer and said loads.

7. The circuit of claim 1, wherein voltages at said low voltage sides of said loads coupled to said current balance circuit are lower than voltages at said high voltage sides of said loads coupled to said transformer.

8. The circuit of claim 1, further comprising:

a protection circuit coupled to said low voltage sides of said series-coupled load pairs and operable for generating a voltage feedback signal.

9. The circuit of claim 8, wherein said protection circuit comprises:

a plurality of voltage sensing circuits coupled to said low voltage sides of said loads for generating a plurality of sensing voltages indicative of voltages at said low voltage sides of said loads; and a resistor-capacitor circuit coupled to said voltage sensing circuits for generating said voltage feedback signal based on said sensing voltages.

10. A system comprising:

an inverter for driving a plurality of lamp pairs, including a first through an $M^{th}$ lamp pair where M is an integer and at least 3, wherein said lamp pairs each includes a first lamp and a second lamp, wherein said first lamp and said second lamp are coupled in series;

a current balance circuit having a first through an $M^{th}$ balance chokes coupled to low voltage sides of said lamp pairs, wherein said balance chokes each has a first winding and a second winding, and wherein said first winding of said first balance choke is electrically coupled in series with said second winding of said $M^{th}$ balance choke, a low voltage side of a first lamp of said first lamp pair and a low voltage side of a second lamp of said $M^{th}$ lamp pair, and said first winding of a $(K+1)^{th}$ balance choke is coupled in series with said second winding of a $K^{th}$ balance choke, a low voltage side of a first lamp of a $(K+1)^{th}$ lamp pair, and a low voltage side of a second lamp of a $K^{th}$ lamp pair, where $K=M-1$; and a protection circuit coupled to said low voltage sides of said lamp pairs for generating a voltage feedback signal.

11. A method comprising:

receiving a DC voltage;

converting said DC voltage to an AC voltage;

driving a plurality of loads arranged as a plurality of series-coupled load pairs with said AC voltage, wherein said loads include a first through an $N^{th}$ load where N is an even integer and at least 4, said plurality of loads having a high voltage side and a low voltage side, and wherein a transformer is coupled with said high voltage side of said plurality of loads;

generating a plurality of load currents flowing through said series-coupled load pairs;

balancing said load currents by a current balance circuit having at least one balance choke including a first winding and a second winding, wherein said first winding of said at least one balance choke is coupled in series with said low voltage side of said first load and said low voltage side of a second load of said series-coupled load pairs, and said second winding of said at least one balance choke is coupled in series with said low voltage side of an $N-1^{th}$ load and said low voltage side of said $N^{th}$ load of said series-coupled load pairs; and generating a feedback signal indicative of a corresponding load current flowing through said series-coupled load pair by a current sense circuit, wherein said current sense circuit is coupled between said low voltage side of a load of said series-coupled load pair and said at least one balance choke.

12. The method of claim 11, wherein N is at least 6 and wherein said current balance circuit includes only a first through an $((N/2)-1)^{th}$ balance chokes, and wherein said balance chokes each includes a first winding and a second winding, and wherein said first winding of said first balance choke is coupled in series with said low voltage side of said first load and said low voltage side of a second load, and said first winding of a $(K+1)^{th}$ balance choke is coupled in series with said second winding of a $K^{th}$ balance choke, said low voltage side of a $(2K+1)^{th}$ load and said low voltage side of a $(2K+2)^{th}$ load, where $K=(N/2)-2$.

13. The method of claim 11, wherein N is at least 6 and wherein said current balance circuit includes only a first through an $(N/2)^{th}$ balance chokes, and wherein said balance chokes each includes a first winding and a second winding, and wherein said first winding of said first balance choke is coupled in series with said second winding of said $(N/2)^{th}$ balance choke, said low voltage side of said first load and said low voltage side of said $N^{th}$ load, and said first winding of a $(K+1)^{th}$ balance choke is coupled in series with said second winding of a $K^{th}$ balance choke, said low voltage side of a $(2K+1)^{th}$ load and said low voltage side of a $(2K)^{th}$ load, where $K=(N/2)-1$.

14. The method of claim 11, further comprising:

generating a voltage feedback signal for circuit protection based on voltages at said low voltage sides of said series-coupled load pair.

15. The method of claim 11, wherein said current sense circuit is grounded.

16. The method of claim 11, wherein said loads comprise cold cathode fluorescent lamps (CCFLs).

17. The method of claim 11, wherein voltages at said low voltage sides of said series-coupled load pairs coupled to said current balance circuit are lower than voltages at sides of said series-coupled load pairs receiving said AC voltage.

* * * * *